US007891041B2

(12) United States Patent
Dyer et al.

(10) Patent No.: US 7,891,041 B2
(45) Date of Patent: Feb. 22, 2011

(54) DEVICE FOR APPLYING A UNIFORM COATING OF FLOOR FINISH

(75) Inventors: John J. Dyer, Shoreview, MN (US); Mitchell T. Johnson, Hudson, WI (US); Erik J. Johnson, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 858 days.

(21) Appl. No.: 11/840,346

(22) Filed: Aug. 17, 2007

(65) Prior Publication Data

US 2009/0047055 A1 Feb. 19, 2009

(51) Int. Cl.
*A47L 13/26* (2006.01)

(52) U.S. Cl. ..... 15/245.1; 15/104.31; 15/233; 401/139

(58) Field of Classification Search ..... 15/245.1
See application file for complete search history.

(56) References Cited

U.S. PATENT DOCUMENTS 1,586,337 A * 5/1926 Stockwell ..... 15/104.31
2,516,396 A * 7/1950 Kersh ..... 15/233
2,876,476 A * 3/1959 Woods ..... 401/206
2,884,655 A * 5/1959 Maddox ..... 15/144.2
4,059,358 A 11/1977 Arai
5,406,670 A * 4/1995 Juratovac et al. ..... 15/229.2
6,523,212 B2 * 2/2003 Cesak et al. ..... 15/175
2004/0055103 A1 3/2004 Varner

FOREIGN PATENT DOCUMENTS

JP 2005-230767 A 9/2005

* cited by examiner

*Primary Examiner*—Monica S Carter
*Assistant Examiner*—Stephanie Newton
(74) *Attorney, Agent, or Firm*—Kenneth B. Wood

(57) ABSTRACT

A device that can be used to spread a thin, even coating of liquid material on a surface is provided. In one embodiment the device is adapted to be used to apply floor coating on a floor surface. The device is configured such that the applicator portion of the device applies a generally constant contact force on the surface, even when the force applied by the user on the tool varies.

18 Claims, 6 Drawing Sheets

DEVICE FOR APPLYING A UNIFORM COATING OF FLOOR FINISH

FIELD OF THE DISCLOSURE

The present invention relates to an applicator system, particularly an application assembly, configured for applying a coating or film to a substrate surface such as a floor.

BACKGROUND

Higher viscosity floor coatings (such as epoxies and polyurethanes) can be difficult to properly apply using known applicators. Typically, if the user applies too much force on the applicator, the coating becomes too thin and visible imperfections become evident. On the other hand, if the user applies too little force to the applicator, pools of the coating form and visible imperfections become evident. The present disclosure provides an applicator that addresses the above issues.

SUMMARY

The present disclosure, among other things, provides a device that can be used to spread a thin, even coating of liquid material on a surface. For example, the device can be used to apply floor shine on a floor surface. The device is configured such that the applicator portion of the device applies a generally constant contact force on the surface even when the force applied by the user on the tool varies.

DETAILED DESCRIPTION OF THE PREFERRED EMBODIMENT

Figure 1:
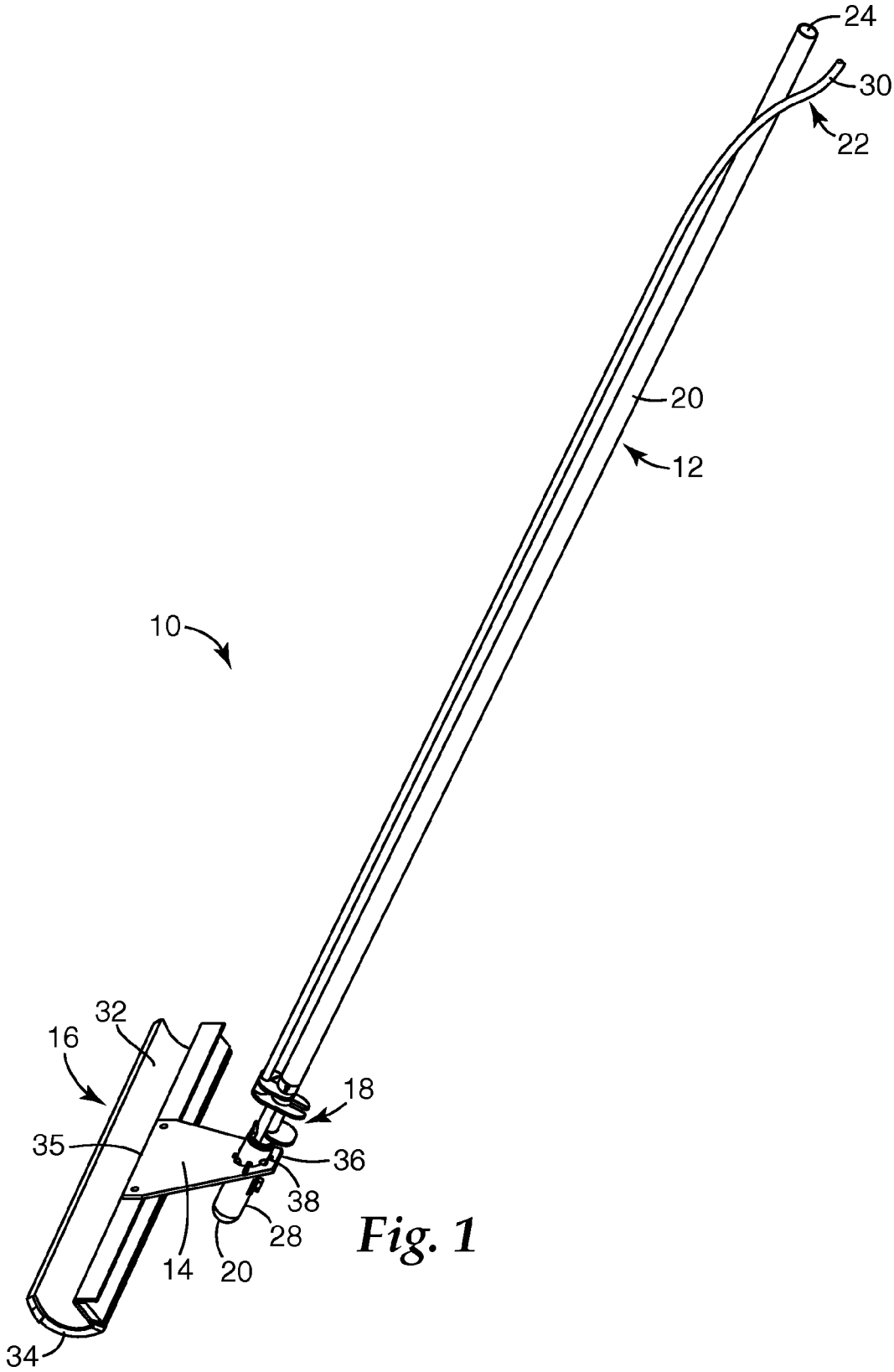
FIG. 1 is a perspective view of a surface coating device according to an embodiment of the disclosure.

Referring to FIGS. 1-4, a surface coating device according to one embodiment of the present disclosure is shown. The depicted coating device 10 includes a handle 12, a connecting member 14, and an accessory 16. The handle 12 can be any structure that the operator can hold onto and use to control the accessory 16.

In the depicted embodiment the handle 12 includes a first portion 18 that includes a distal end 20 of the handle 12 and a second end portion 22 that includes a proximal end 24 of the handle 12. The distal end 20 is the end of the handle 12 that is closer to the accessory 16, and the proximal end 24 is the end of the handle that is opposite the distal end 20. In the depicted embodiment the handle 12 includes a shaft 26 and a guide member 28 attached to the shaft 26 at the first end portion 18 of the handle 12. The shaft 26 in the depicted embodiment is sized such that the device 10 can be used while the operator is standing. It should be appreciated that the handle 12 can be of any suitable configuration. For example, the handle 12 can in an alternative embodiment be configured to be grasped by one hand rather than two. In the depicted embodiment the handle 12 also includes a hose 30 attached to thereto for dispensing fluid to the accessory 16 or to the surface to be coated.

In the depicted embodiment the accessory 16 includes a frame 32 that is configured to support an applicator 34. In the depicted embodiment the applicator 34 is a pad. However, it should be appreciated that the applicator 34 in alternative embodiments need not be a pad. For example, the applicator could be a wiper blade, a cloth, a sponge, or a part of the frame itself. The frame 32 in the depicted embodiment has a length $L_1$ (FIG. 3) that is between about 10-36 inches. However, it should be appreciated that the frame can be of many other sizes as well.

Figure 2:
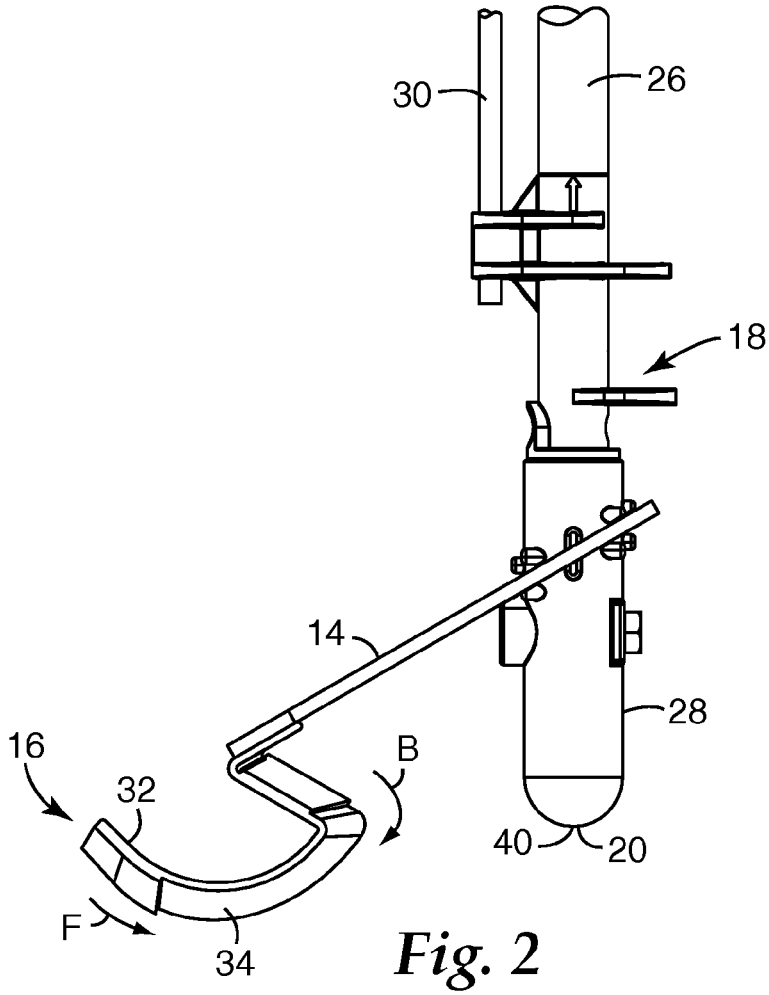
FIG. 2 is a side view of a lower portion of the device of FIG. 1.
Figure 3:
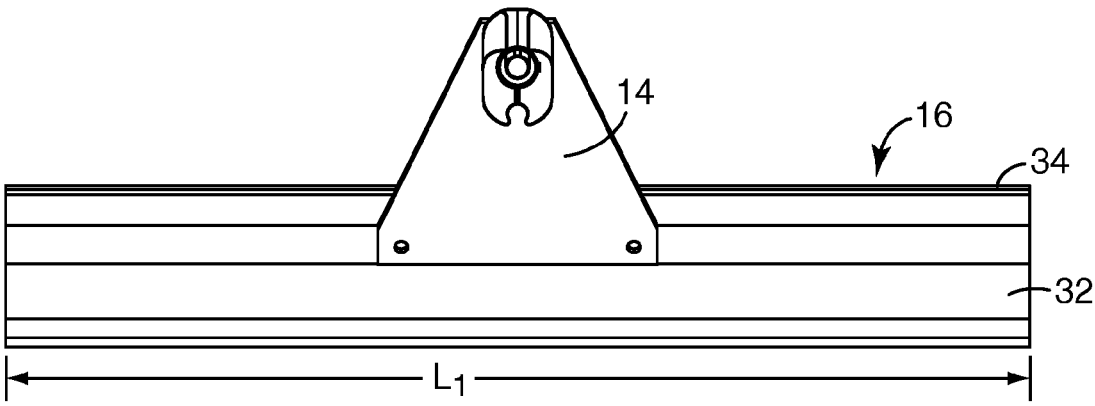
FIG. 3 is a top view of the lower portion of the device of FIG. 1.
Figure 4:
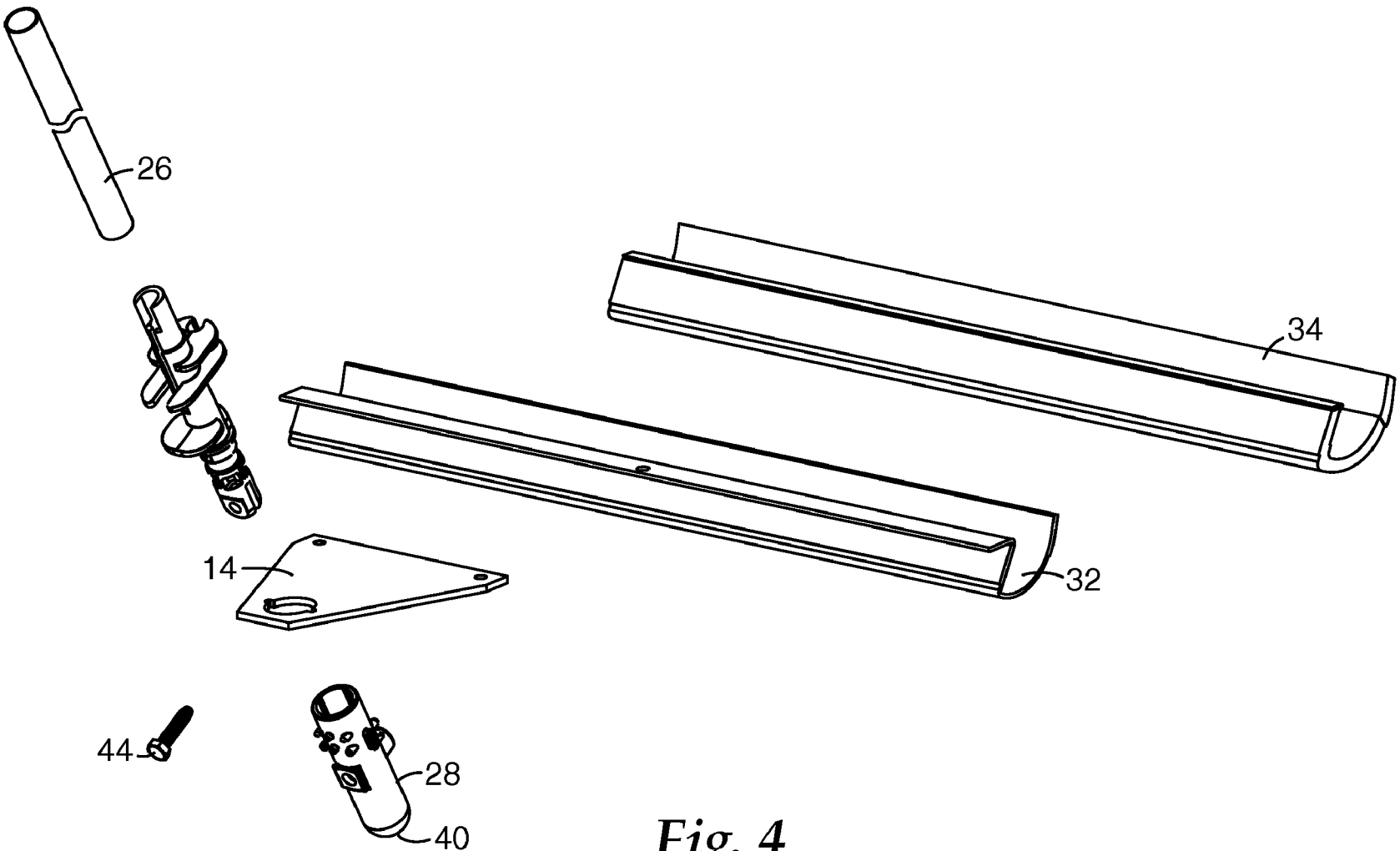
FIG. 4 is an assembly view of the lower portion of the device of FIG. 1.

Referring to FIG. 2, the end profile of the frame 32 in the depicted embodiment is generally convex relative to a surface to be coated. The convex profile of the frame 32 allows the applicator 16 to be in continuous contact with the surface (e.g., a floor surface) even if the applicator 16 rolls forward F or backward B (FIG. 2) from its normal orientation. It should be appreciated that many other frame configurations are possible. For example, the end profile of alternative embodiments of the frame can be circular, elliptical, triangular, rectangular, or irregular.

Figure 5A:
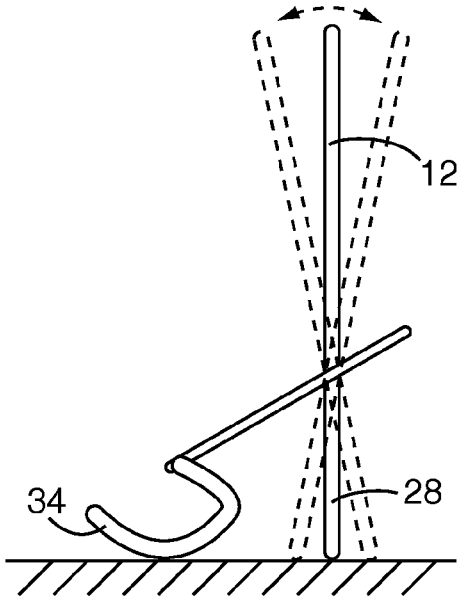
FIGS. 5*a-c* are schematic views showing the handle moving relative to the applicator.
Figure 5B:
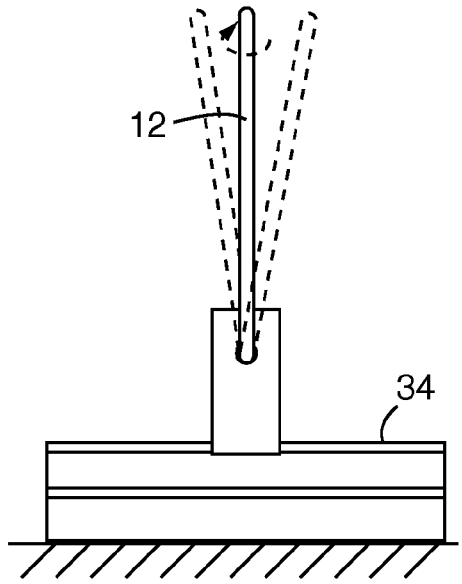
Figure 5C:
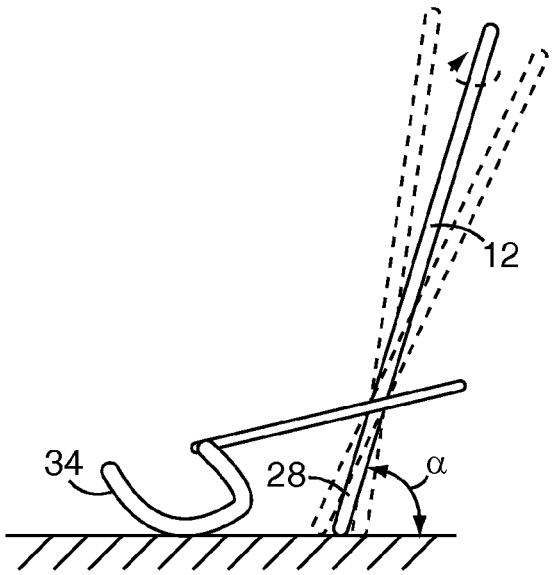
Figure 6A:
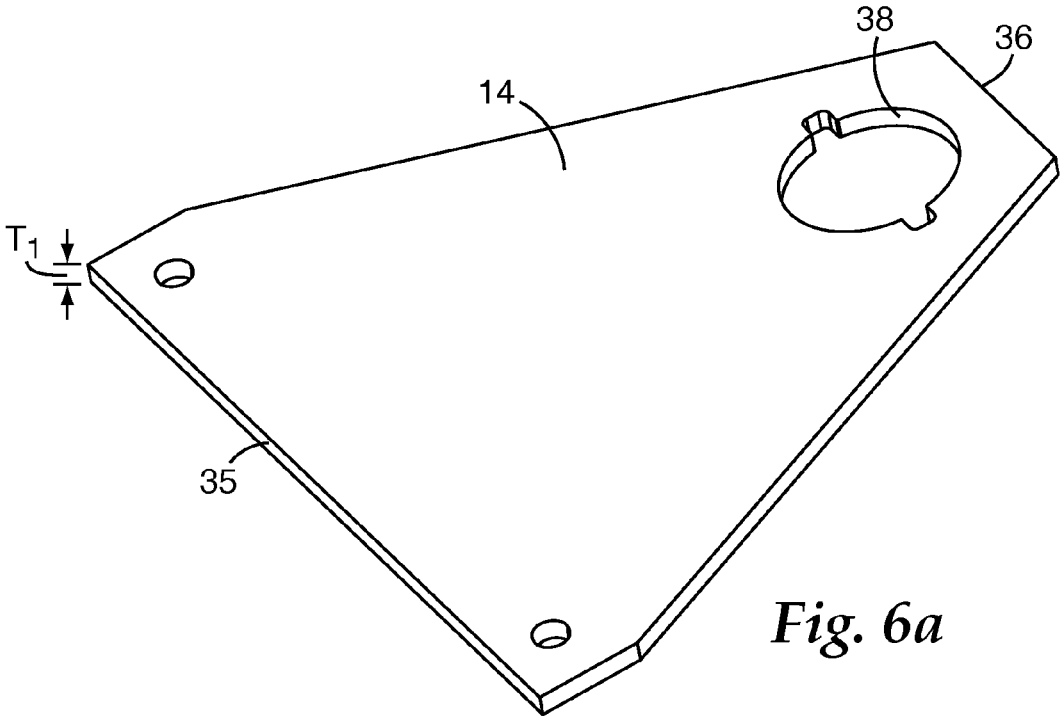
FIG. 6*a* is a perspective view of a connecting member that connects a handle and an applicator of FIG. 1.
Figure 6B:
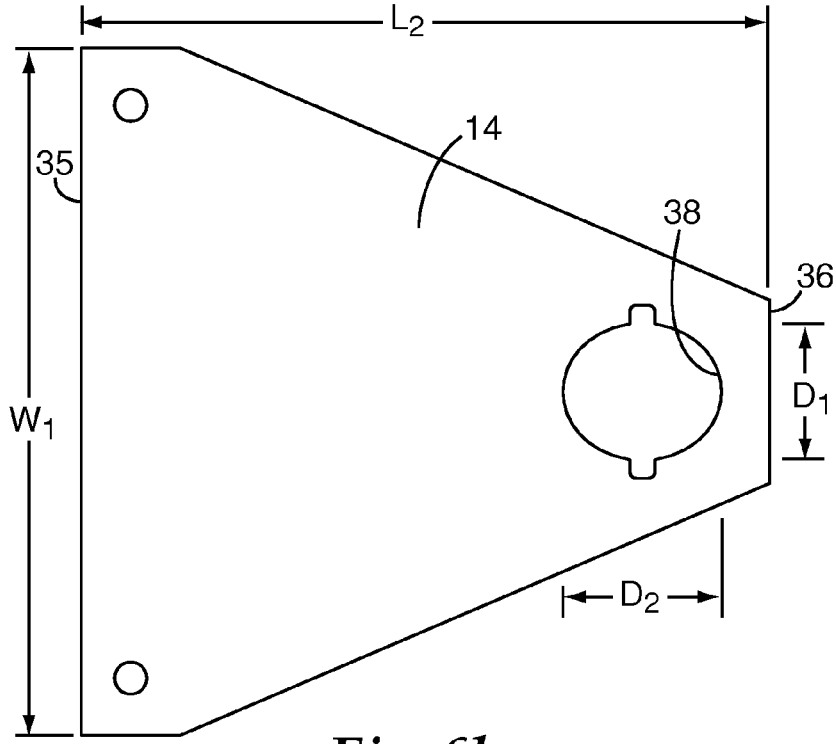
FIG. 6*b* is a top view of the connecting member of FIG. 6*a;*
Figure 7A:
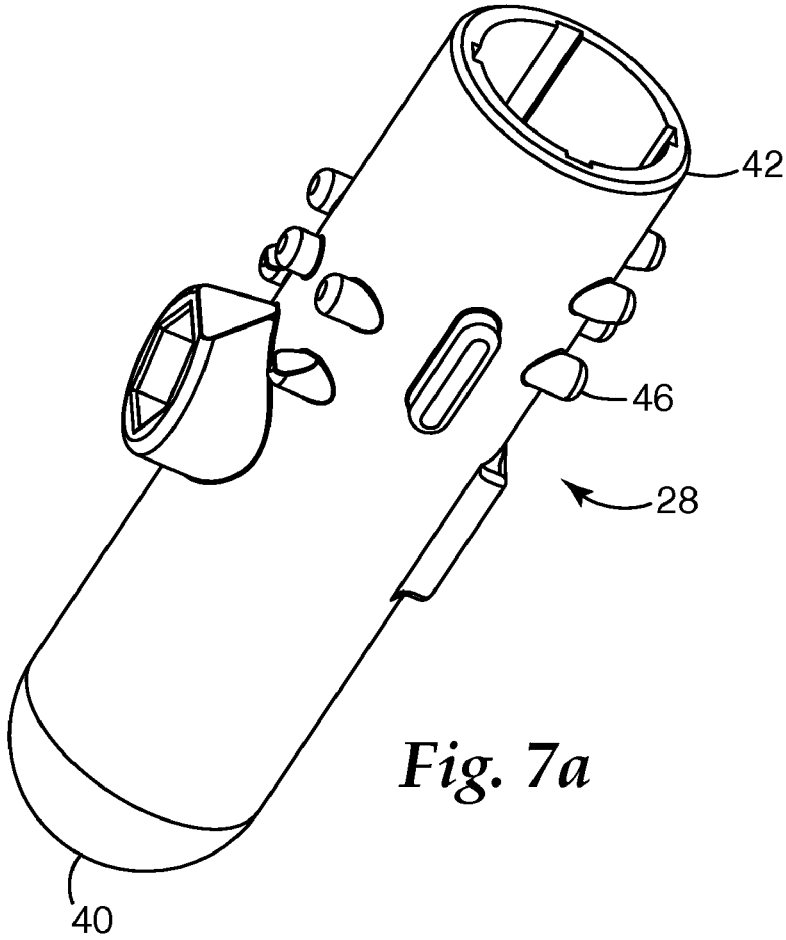
FIG. 7*a* is a perspective view of a guide member that connects to the handle of FIG. 1.
Figure 7B:
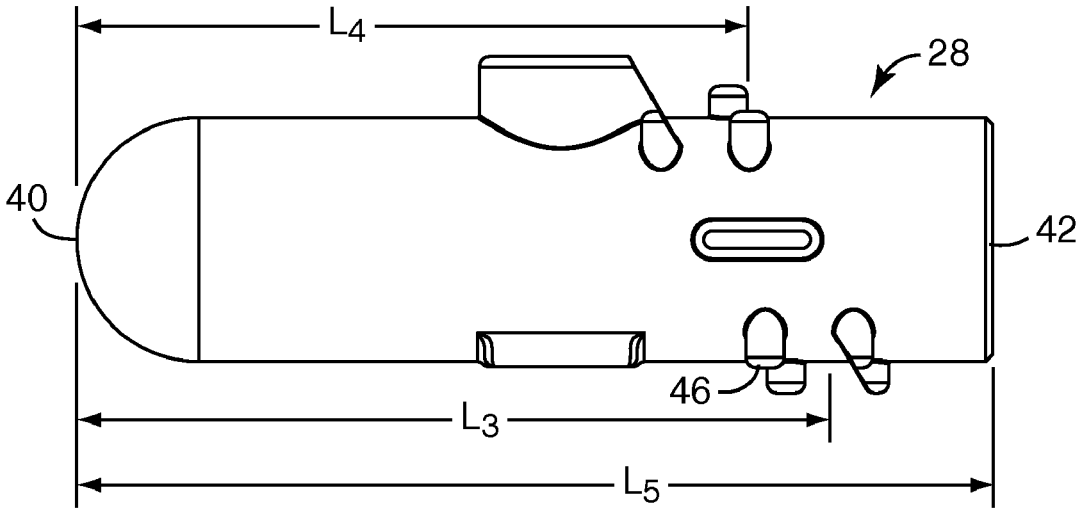
FIG. 7*b* is a side view of the guide member of FIG. 7*a*.

Referring to generally to FIGS. 1-6*b* and primarily to FIGS. 6*a* and 6*b*, the connecting member 14 is described herein in greater detail. The connecting member 14 includes a first end portion 35 attached to the accessory 16 and a second end portion 36 attached to the handle 12. In the depicted embodiment the connecting member 14 has a generally triangular shaped with the first end portion 35 generally defining the base of the triangle and the second end portion 36 generally defining the apex of the triangle. The connecting member 14 includes an aperture 38 for receiving a portion of the handle 12. The aperture 38 is located in the second end portion 36 of the connecting member 14 and is generally elliptical in shape.

In the depicted embodiment, the smaller diameter $D_1$ of the aperture 38 is about 1.2 inch and the larger diameter $D_2$ of the aperture is about 1.4 inch. In the depicted embodiment the smaller diameter $D_1$ is within about 5-15 percent the diameter $D_2$ of the guide member 28. In the depicted embodiment the aperture 38 includes a pair of opposed notches in the $D_1$ direction which engage portions of the guide member 28. In the depicted embodiment the width $W_1$ of the first end 35 is between 5 to 7 inches, the length $L_2$ from the first end to the second end is between 5 to 7 inches, and the thickness $T_1$ of the connecting member is between about ⅛-¼ inch. However, it should be appreciated that alternative embodiments of the connecting member 14 can be of many other geometric configuration and sizes.

In the depicted embodiment, the body of the connecting member comprises a flexible construction. More particularly, a portion of the connecting member 14 in the depicted embodiment comprises a rubber construction. It should be appreciated that the connecting member can have many other alternative geometries and can be made of many different types of materials. For example, the overall shape of alternative embodiments of the connecting member can be circular, elliptical, rectangular, cylindrical, or irregular, and portions of the connecting member can be constructed of a combination of polymeric material, wood material, and/or metal.

Referring to FIGS. 2, 4, 7*a*, and 7*b*, the guide member 28 is described herein in greater detail. In the depicted embodiment the guide member 28 includes a first end 40 which is domed shaped and a second end 42 that is hollow and configured to receive a portion of the shaft 26. The guide member 28 of the depicted embodiment is detachable from the shaft 26 portion of the handle 12 via a fastener 44 (FIG. 4) that traverses through the guide member 28 and a portion of the shaft 26 that is received within the guide member 28. The guide member 28 includes a retaining arrangement 46 configured to engage the connecting member 14. In the depicted embodiment the retaining arrangement 46 includes beads that hold the connecting member 14 at a location on the guide member 28 while allowing the guide member 28 and the connecting member 14 to move relative to each other. For example, in the depicted embodiment the guide member 28 can rotate about the axis of the handle 12 relative to the connecting member 14.

In the depicted embodiment, the guide member 28 includes protrusions that are configured to be received in the notches of the aperture 38 of the connecting member 14. The guide member 28 includes an overall length of $L_5$, which is between about 3-5 inches. The guide member 28 includes protrusions on a first side of the guide member 28 at a distance $L_3$, between about 3.5-4.0 inches, from the first end 40 of the guide member 28 for engaging the connecting member 14. The guide member 28 includes protrusions on a second side of the guide member 28 at a distance $L_4$, between about 3.0-3.5 inches, from the first end 40 of the guide member 28 for engaging the connecting member 14. However, it should be appreciated that alternative embodiments of the guide member 28 can be of many other geometric configuration and sizes.

In the depicted embodiment, the protrusions on the guide member 28 cooperate to support the connecting member 14. In the depicted embodiment the connecting member and the protrusion are connected without fasteners. It should be appreciated that the guide member 28 in alternative embodiments can be connected to the connecting member 14 in a different manner. For example, the guide member could be formed together with the connecting member as a single piece. In another alternative embodiment the guide member and the handle are formed of a single piece and the connecting member is fastened to the piece.

Referring to back to FIGS. 5*a*-5*c*, schematic views of the device are shown. Generally, FIGS. 5*a*-5*c* illustrate that the handle 12 can be moved in a number of ways without causing any portion of the applicator to lift off the surface. FIG. 5*a* illustrates that the handle can be pivoted back and forth with the first end 40 of the guide member 28 on the surface while the applicator 34 maintains contact with the surface. In the depicted embodiment the applicator 34 can remain generally in the same position while the handle is pivoted back and forth. FIG. 5*b* illustrates that the handle can be pivoted from side to side with the first end 40 of the guide member 28 on the surface while the applicator 34 maintains contact with the surface. In the depicted embodiment the applicator 34 can remain generally in the same position while the handle is pivoted from side to side. FIG. 5*c* illustrates that the handle can be moved in any direction with the first end 40 of the guide member 28 on the surface, while the applicator 34 maintains contact with the surface, so long as the angle of the handle 12 to the surface is greater than $\alpha$ degrees. In the depicted embodiment the applicator 34 can remain generally in the same position while the handle is pivoted such that the angle $\alpha$ between the handle 12 and the floor remains greater than about 40 degrees. FIG. 5*c* also illustrates that the handle 12 can be rotated about its axis while the applicator 34 maintains contact with the surface.

FIGS. 5*a*-5*c* further illustrate that in the depicted embodiment the downward forced applied to the handle 12 is generally not transferred to the applicator 34. The downward force applied by the operator onto the handle 12 is transferred to the surface via the first end 40 of the guide member 28. Lateral forces (i.e., pulling and pushing forces) are generally transferred from the handle 12 to the applicator 34. This functionality enables the operator to control the applicator 34 yet maintain a relatively constant contact force between the applicator 34 and the surface. It also prevents the applicator 34 from undesirably losing contact with the surface as a result of erratic movements of the handle 12.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A surface coating device comprising:

a handle including a first end portion and a second end portion;

an applicator; and a connecting member including an aperture therein, wherein the applicator is connected to the connecting member, and wherein the first end portion of the handle extends through the aperture;

wherein the device is configured such that a portion of the applicator remains in contact with a floor surface when the first end portion of the handle is in contact with a surface to be coated and an angle between the handle and the surface in a vertical plane is greater than 40 degrees.

2. The device according to claim 1, wherein the connecting member comprises a rubber construction.

3. The device according to claim 1, wherein the connecting member includes a first end adjacent the applicator and a second end adjacent the handle, wherein the connecting member tapers from the first end towards the second end.

4. The device according to claim 1, wherein the width of the connecting member at a first end is between 5-7 inches and the length of the connecting member from the first end to the second end is between 4.5-6.5 inches.

5. The device according to claim 1, wherein the first end portion includes a guide member, and wherein the guide member of the first end potion extends through the aperture in the connecting member.

6. The device according to claim 1, wherein the applicator includes a convex end profile.

7. The device according to claim 1, wherein the device is configured such that the connecting member does not transmit a downward force applied to the handle onto the applicator.

8. A surface coating device comprising:

a handle including a first end portion and a second end portion;

an applicator; and a connecting member, the connecting member including a flexible body portion; wherein the applicator is connected to the handle via the connecting member;

wherein the device is configured such that a portion of the applicator remains in contact with a floor surface when the first end portion of the handle is in contact with a surface to be coated and an angle between the handle and the surface in a vertical plane is greater than 40 degrees.

9. The device of claim 8, wherein the handle includes a distal end and a proximal end and the connecting member connects to the handle between the distal and proximal ends of the handle.

10. The device of claim 8, wherein the handle and connecting member are connected without fasteners.

11. The device according to claim 8, wherein the connecting member comprises a rubber construction.

12. The device according to claim 8, wherein the connecting member comprises a polymeric construction.

13. The device according to claim 8, wherein the device is configured such that the connecting member does not directly transmit a downward force applied to the handle onto the applicator.

14. A surface coating device comprising:

a handle including a first end portion and a second end portion and a shaft;

a guide member configured to be attached to an end of the shaft;

an applicator; and a connecting member, the connecting member including a flexible body portion;

wherein the applicator is connected to the guide member via the connecting member;

wherein the device is configured such that a portion of the applicator remains in contact with a floor surface when the first end portion of the handle is in contact with a surface to be coated and an angle between the handle and the surface in a vertical plane is greater than 40 degrees.

15. The device according to claim 14, wherein the applicator has a convex end profile.

16. The device according to claim 14, wherein the guide member includes a hollow end portion that receives an end portion of the shaft.

17. The device according to claim 14, wherein the end portion of the shaft is dome shaped.

18. The device according to claim 14, wherein the device is configured such that the connecting member does not transmit a downward force applied to the guide member onto the applicator.

* * * * *